US006443212B1

(12) United States Patent
Choudhury et al.

(10) Patent No.: US 6,443,212 B1
(45) Date of Patent: Sep. 3, 2002

(54) METHOD AND APPARATUS FOR THE PRODUCTION OF PRECISION CASTINGS BY CENTRIFUGAL CASTING

(75) Inventors: Alok Choudhury, Puttlingen; Matthias Blum, Büdingen; Harald Scholz, Frankfurt am Main; Georg Jarczyk, Grosskrotzenburg; Franz Hugo, Aschaffenburg; Hans Günther Fellmann, Obertshausen; Peter Busse, Aachen; Thomas Ruppel, Bad-Soden Salmünster; Alfred Henn, Rodenbach, all of (DE)

(73) Assignee: Ald Vacuum Technologies AG, Erlensee (DE)

( * ) Notice: Subject to any disclaimer, the term of this patent is extended or adjusted under 35 U.S.C. 154(b) by 0 days.

(21) Appl. No.: 09/409,629

(22) Filed: Oct. 1, 1999

(30) Foreign Application Priority Data

Oct. 10, 1998 (DE) ..... 198 46 781

(51) Int. Cl.[7] ..... B22D 13/04; B22D 13/10; B22D 29/00; B22D 27/04

(52) U.S. Cl. ..... 164/118; 164/116; 164/131; 164/122.1; 164/298

(58) Field of Search ..... 164/286, 290, 164/292, 293, 295, 296, 298–300

(56) References Cited

U.S. PATENT DOCUMENTS 3,929,182 A * 12/1975 Amado, Jr. ..... 164/114
4,061,181 A * 12/1977 Ficek ..... 164/292
4,139,049 A * 2/1979 Baumann et al. ..... 164/292
5,626,179 A * 5/1997 Choudhury et al. ..... 164/66.1
5,950,706 A 9/1999 Choudhury et al. ..... 164/290

FOREIGN PATENT DOCUMENTS

EP 686443 12/1995

* cited by examiner

*Primary Examiner*—M. Alexandra Elve
*Assistant Examiner*—Kevin McHenry
(74) *Attorney, Agent, or Firm*—Fulbright & Jaworski L.L.P.

(57) ABSTRACT

Molds (1) with annular mold parts (2, 3) divided by at least one plane of division (E—E) and forming a plurality of cavities (8) disposed at least substantially radially to a centrifugation axis (A—A), serve for the production of precision castings by centrifugal casting, especially of parts made of materials containing titanium for internal combustion engines, the molds (1) and a casting system being contained in a closed chamber. To automate production, at least one mold part (2, 3) is made to rotate in its own rotational guide, and two mold parts (2, 3) together with the corresponding rotational guides are brought to a closed position for the casting and solidification and to an open position for the removal of the precision castings. When cast, the precision castings are preferably joined together at their radially inward pointing ends by a circumferential ring of the solidified metal and thus a circle of castings can be removed from the opened mold by a manipulating system.

27 Claims, 12 Drawing Sheets

Figure 1:
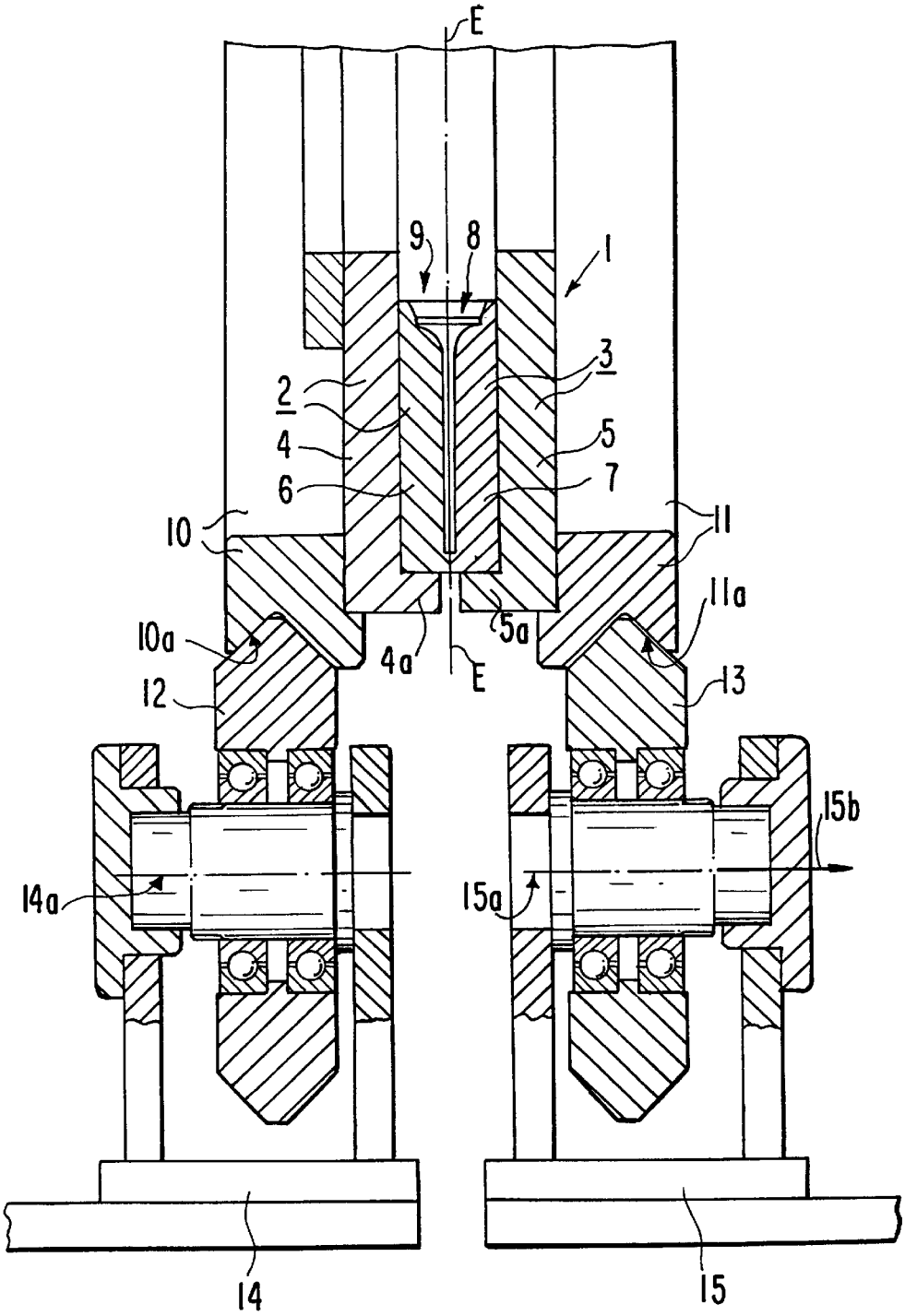

METHOD AND APPARATUS FOR THE PRODUCTION OF PRECISION CASTINGS BY CENTRIFUGAL CASTING

The invention relates to a method for the production of precision castings by centrifugal casting apparatus for the purpose according to the preamble.

What is especially involved is the production of parts from materials containing titanium for internal combustion engines in molds divided by at least one plane of division into annular mold parts with a plurality of mold cavities extending at least substantially radially from a centrifugation axis, the molds and a casting system being housed in a closed chamber.

A method disclosed by EP 0 686 443 A1 deals primarily with the selection of special mold materials which have an influence on the casting and solidification of materials containing titanium, such as

| | |
|---|---|
| Pure titanium | Ti 6 Al 4 V, |
| Ti 6 Al 2 Sn 4 Zr 2 Mo, | Ti 5 Al 2.5 Sn |
| Ti 15 V 3 Al 3 Cr 3 Sn, | Ti Al 5 Fe 2.5 |
| 50 Ti 46 Al 2 Cr 2 Nb | titanium aluminide. |

The invention also extends to such materials, but is not limited thereto. Also involved are other materials such as highly heat resistant nickel aluminides, especially materials which are highly reactive at their casting temperature, including also the materials named in EP 0 686 443 A1.

Possibilities of application are found in the field of internal combustion engines, e.g., for oscillating parts such as valves, connecting rods and piston pins in which mass, noise and temperature are important. Applications, however, are also to be found in the field of rotating machines such as turbine wheels, turbine buckets, compressor wheels and parts thereof; that is to say, all mass products in which manufacturing costs, precision and adherence to all product parameters are of decisive importance, for reasons which are described in EP 0 6868443 A1. Another interesting possible application is in biomedical prostheses such as implants.

In the method disclosed by EP 0 686 443 A1, several rings of castings are made around a central sprue runner, and are combined to form a tree or a cluster of castings even between the rings by the material hardened in the sprue runner. Consequently stripping the casting is difficult and time-consuming, since the castings are to some extent enmeshed with the mold parts and anchored in the mold. To strip it the mold or the stack of plates of mold parts as a whole must be dismounted in the casting chamber, taken out of it and stripped in the open air.

Without a vacuum lock the interior of the casting chamber becomes contaminated by the ambient air and its content of water vapor, and with a vacuum lock the dismounting of the mold is extremely complicated. In either case, however, the mold parts become contaminated in the open air. But even if the mold for producing only a single ring were to consist of only two ring plates, dismounting them inside of the casting chamber would be difficult and the contamination problem still remains.

There is still another consideration: most of the above-described materials are hard and brittle at room temperature: at temperatures between about 200° C. and 300° C. they are solid but still ductile. During the above-described disassembly of stacks of molds with embedded casting trees the latter are cooled to room temperature, so that when they are stripped out fractures occur due to brittleness, resulting in rejects. Furthermore, before each new casting the molds must be reassembled by hand and heated from room temperature to 600° C. to 800° C., which is not only time-consuming but also a waste of energy.

The invention is therefore addressed to the problem of devising a method of the kind described above and an apparatus therefor, which will facilitate stripping the mold and permit a highly automated production of precision castings in a vacuum or under inert gas without damage to the castings and without excessive energy consumption.

The solution of the stated problem is achieved by the invention, stated above, by the features in the specific part of claim 1 and, in the case of the apparatus referred to above, by the features in the specific part.

A highly automated production of precision castings in a vacuum or under inert gas and without damage to the castings and without excessive energy consumption is made possible thereby. In particular the production of precision castings which are mass products for use as engine components is greatly facilitated and lower in cost.

In the invention, stripping the castings from the molds can be performed within the cooling curve at the thermally most favorable point in time at which the cast material is already sufficiently solid but still has sufficient ductility. The molds also do not have to be cooled to room temperature but only to the removal or stripping temperature of, for example, about 300° C., and they can be heated from there back up to the casting temperature of about 600° C. to 800° C., but this is necessary ideally only at the inner margin of the mold. Thus the energy required for heating the molds and the period of time to the next casting are approximately halved. Even in regard to the energy consumption of the entire apparatus there is still an energy saving of 20 to 25%.

The core of the invention thus consists in the fact that the mold parts or mold halves are reliably pressed together parallel to their plane of division despite the high rotatory speed and are carried while rotating, but they can be drawn apart mechanically to remove the castings after they solidify, without any catching or sticking and without the need for cutting a central sprue away manually and at great effort inside or outside of the chamber.

As a result of additional embodiments of the method of the invention it is especially advantageous if, either individually or in combination:

- the precision castings when cast are united at their radially inwardly pointing ends by a circumferential ring of the solidified metal,
- the rotational guides of the casting mold parts are moved relative to one another between the closed position and the open position when the casting system for casting the melt while the mold is closed is brought into the plane of division and the casting is performed, if the mold is opened after the melt has solidified, and if then the precision castings joined together by the ring are removed from the plane of division inside of the chamber,
- in the chamber a manipulator system with a clutching device is disposed, by means of which first, with the mold closed, the castings are picked up by their ring and fixed, if then the movable mold part is removed from the castings and from the stationary mold part, and if then the castings are drawn by the clutching device from the stationary mold part and brought into an intermediate position between the opened mold parts, from which position the castings are taken out into the exterior.
- the mold parts are brought in a coaxial position into two sets of guiding wheels of which at least one guiding wheel is driven, the mold parts are heated in a coaxial position to a casting temperature by a heating system brought concentrically into the plane of division, and/or if the mold parts, to achieve a directional solidification from the outside in, are heated at such a rate that a temperature gradient of at least 40° C., preferably of at least 200° C., diminishing radially from the inside out, is established in the mold parts.

Pursuant to additional embodiments of the apparatus of the invention it is especially advantageous if, either individually or in combination:

the rotational guides are movable relative to one another between a closed position and an extracting position, if the casting system can be brought into the plane of division to cast the melt with the mold closed, and if a manipulator system is present for extracting within the chamber the precision castings joined to one another, the castings are provided on their outer circumference with circumferential guiding means and are held positively in coaxial position on sets of guiding wheels of which at least one guiding wheel can be driven, one of the mold parts is movable together with the corresponding set of guiding wheels relative to the other mold part and the other set of guiding wheels in the direction of the centrifugation axis, the manipulator system has a radially acting clutching device with which the clustered precision castings can be removed from the mold parts, the clutching device has radially movable plungers, the plungers can be operated by a central shaft and bell cranks, the manipulator system is provided on its outer circumference with a heat insulating body and a concentric heating body to heat the mold parts, the chamber consists of two parts with a plane of division and if the one mold part is mounted in the one chamber part and the other mold part in the other chamber part, and/or if the chamber part in which the manipulator system is mounted is connected to a magazine.

At the same time the materials and material combinations can also be taken from EP 0 686 433 A1.

Embodiments of the invention are further explained below with the aid of FIGS. 1 to 13.

Figure 2:
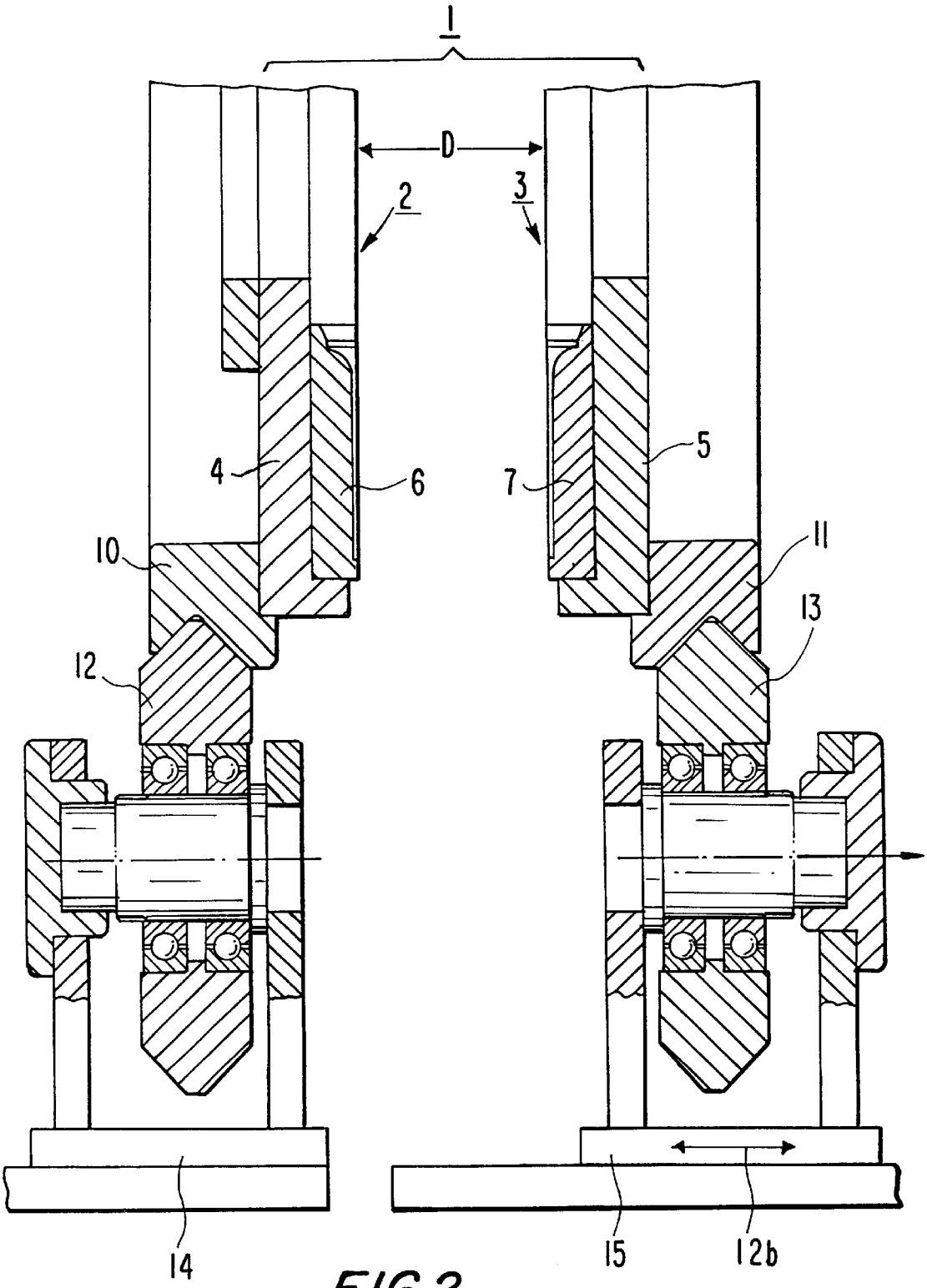
Figure 3:
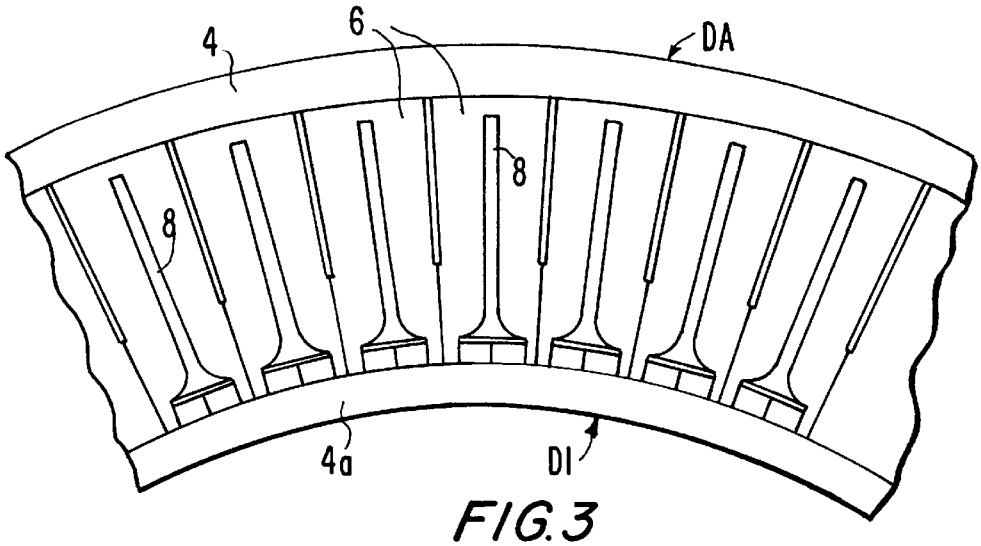
Figure 13:
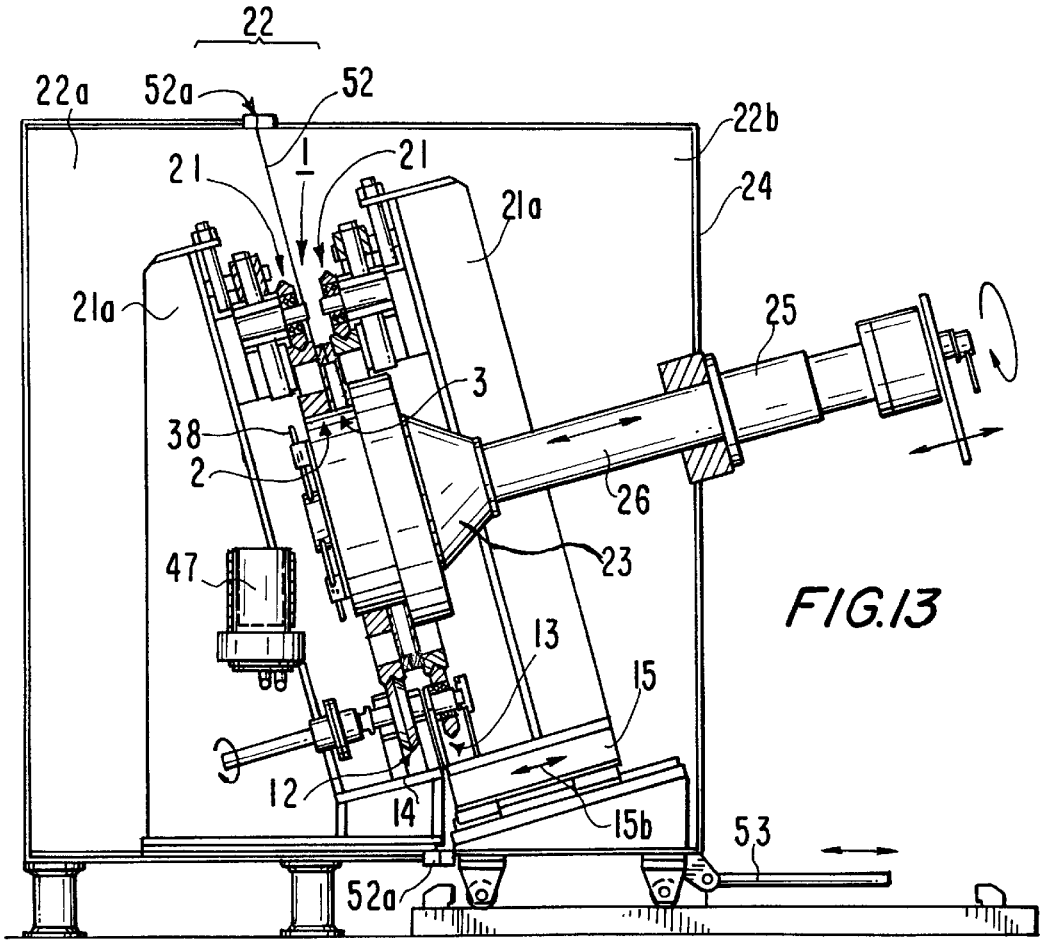
Figure 4:
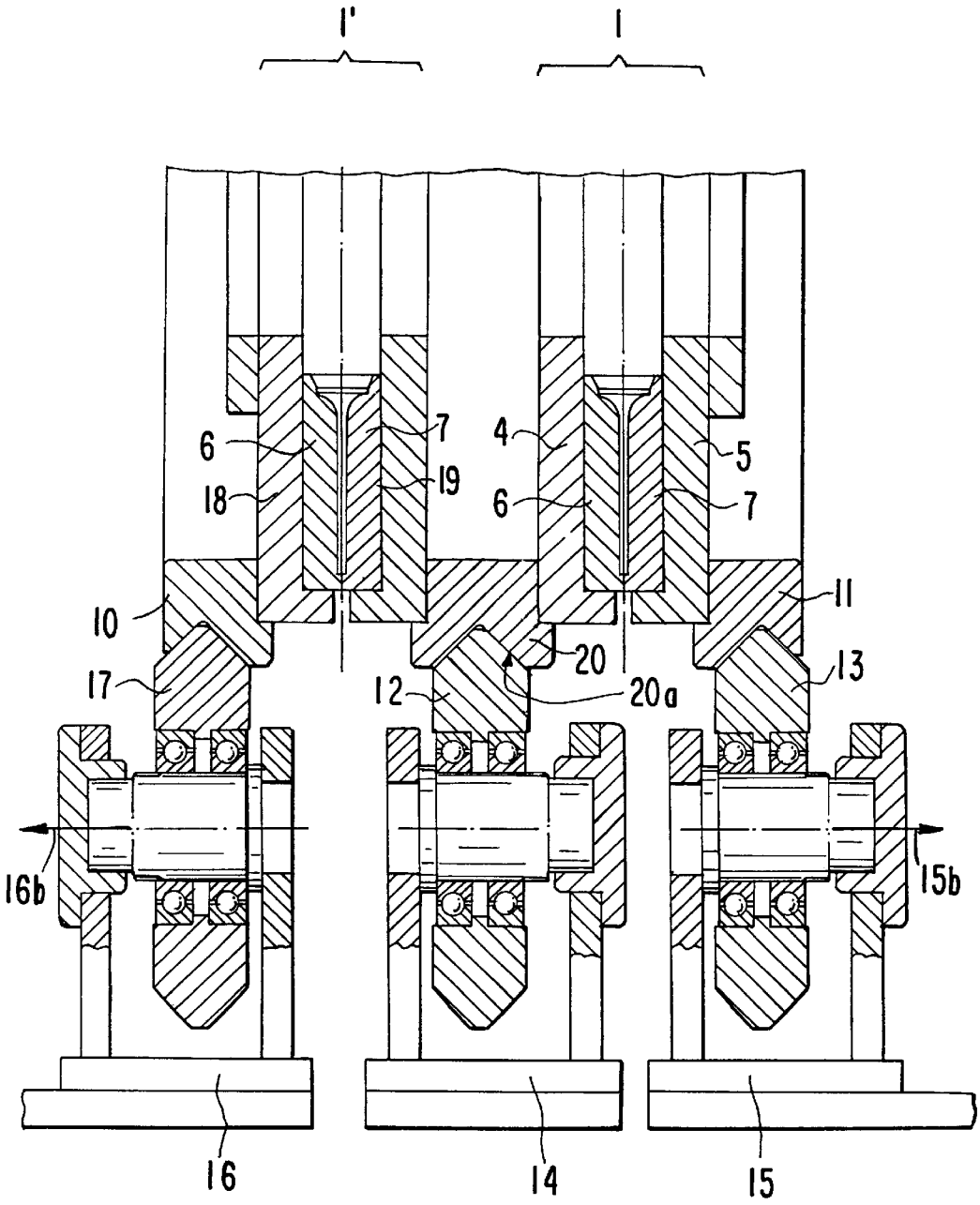
Figure 5:
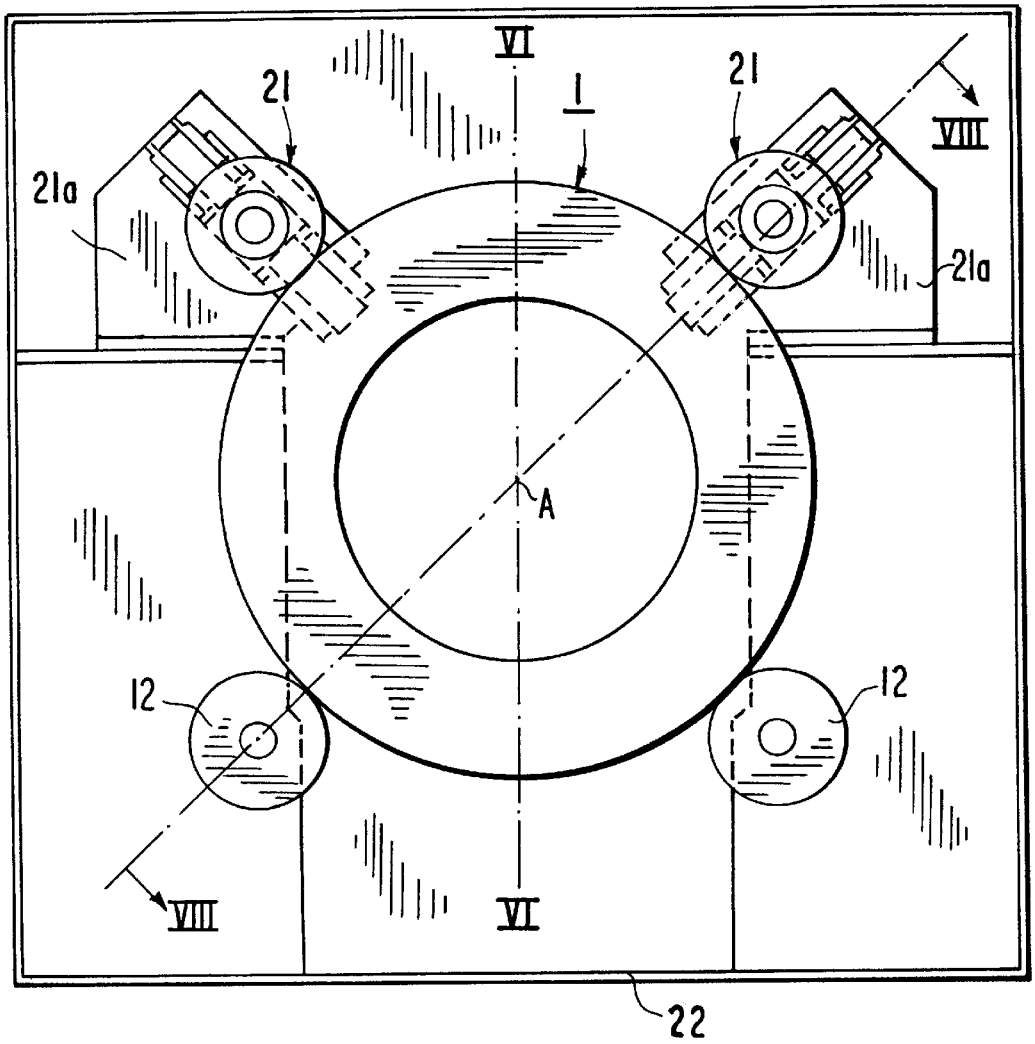
Figure 6:
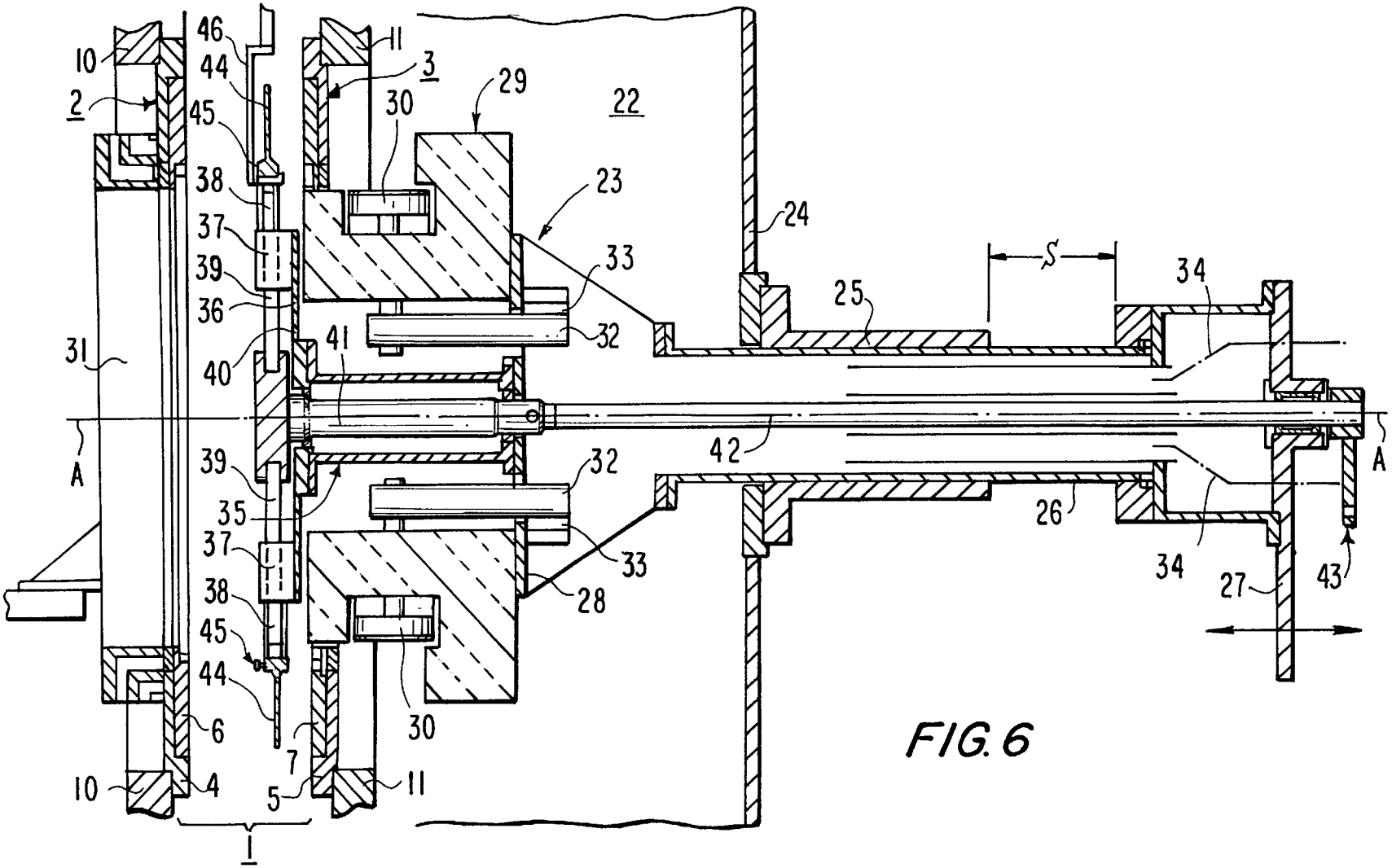
Figure 7:
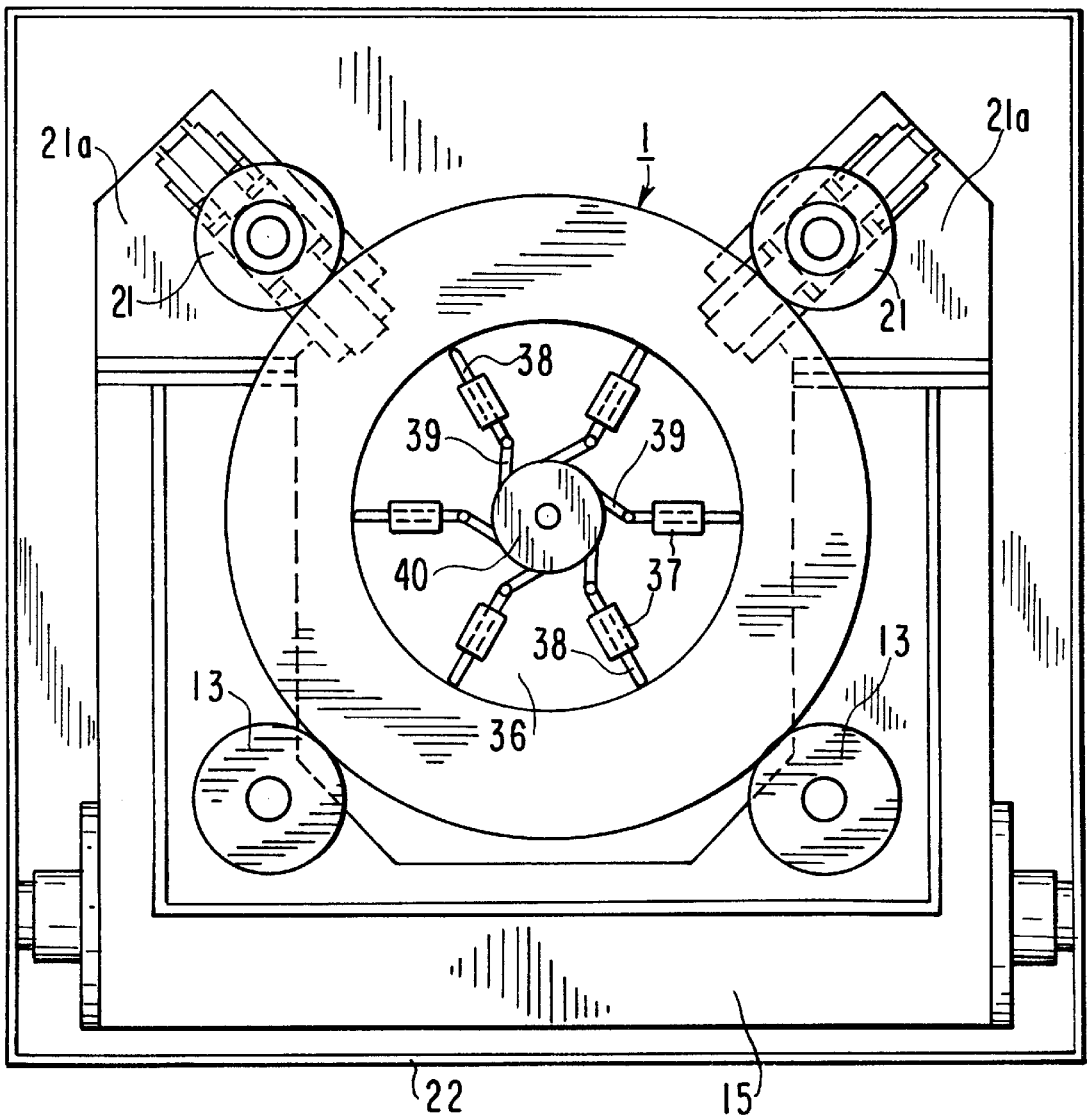
Figure 8:
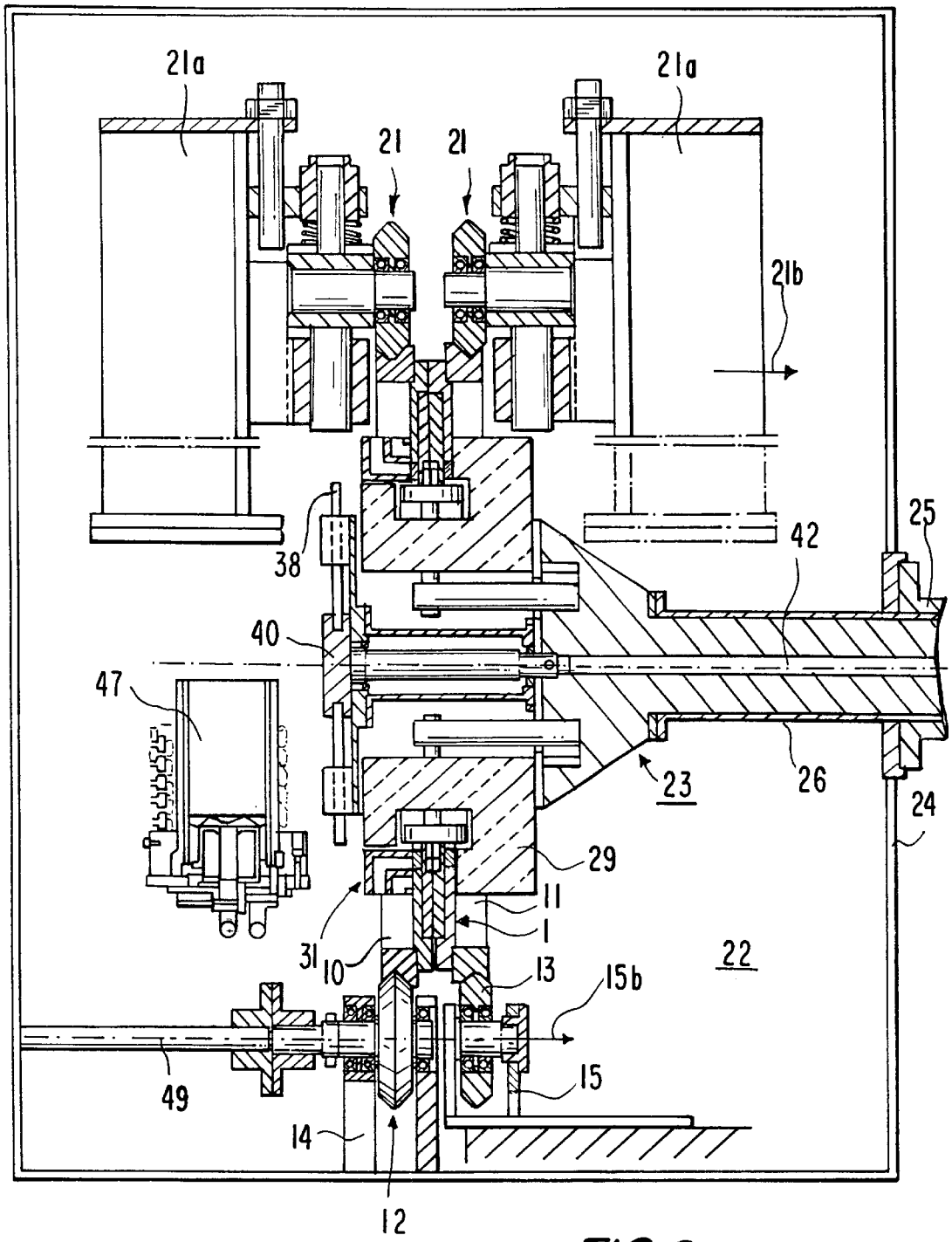
Figure 9:
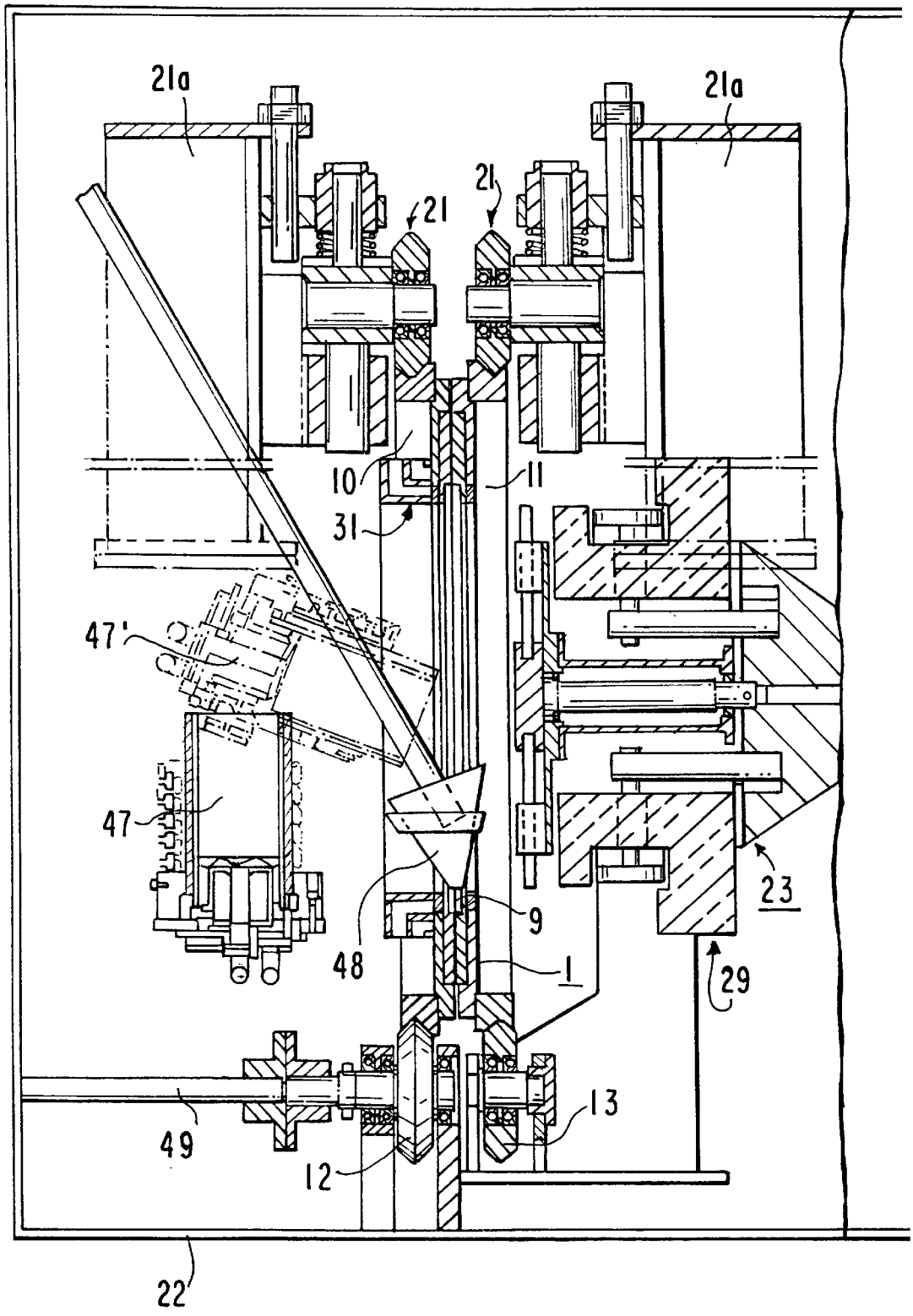
Figure 10:
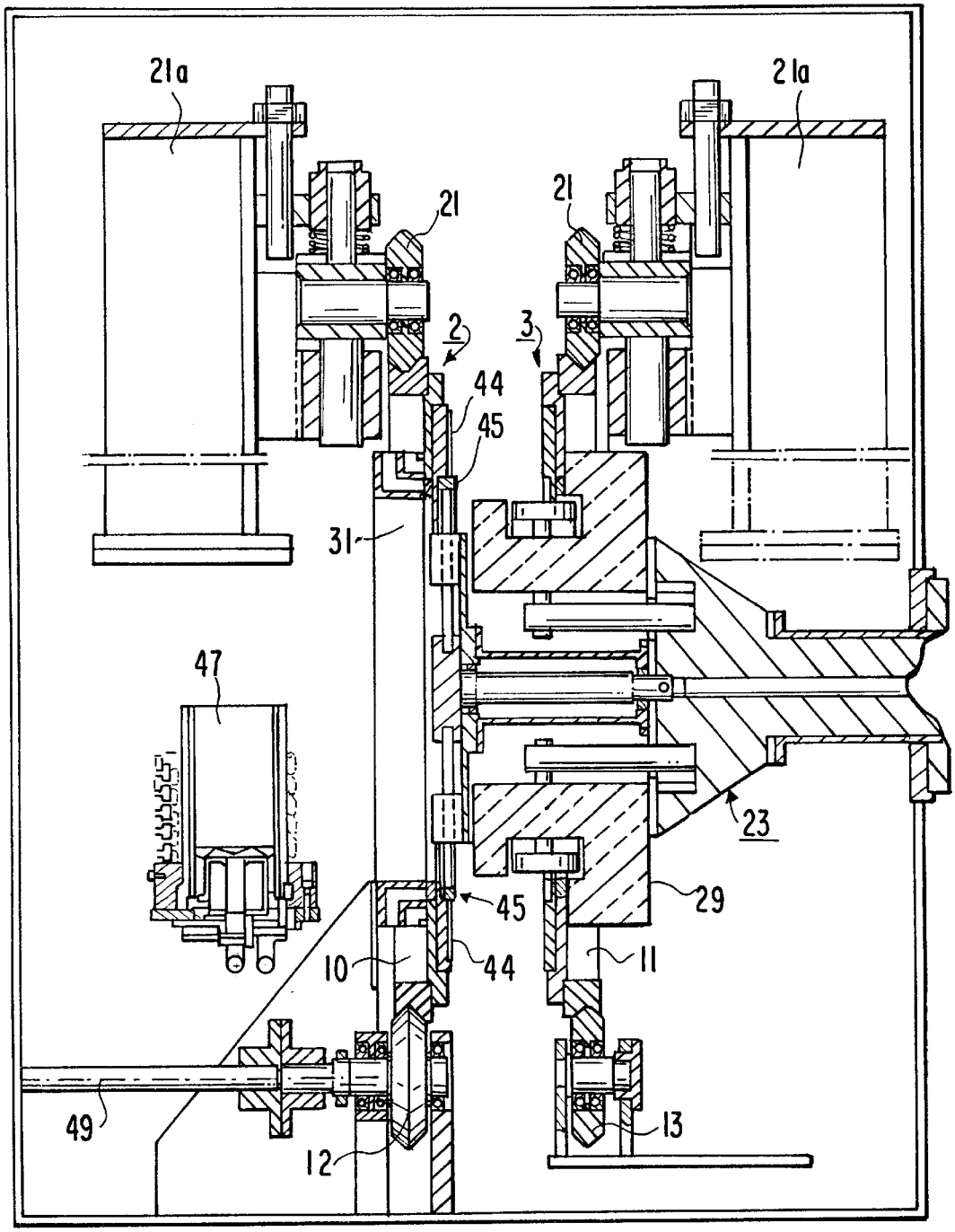
Figure 11:
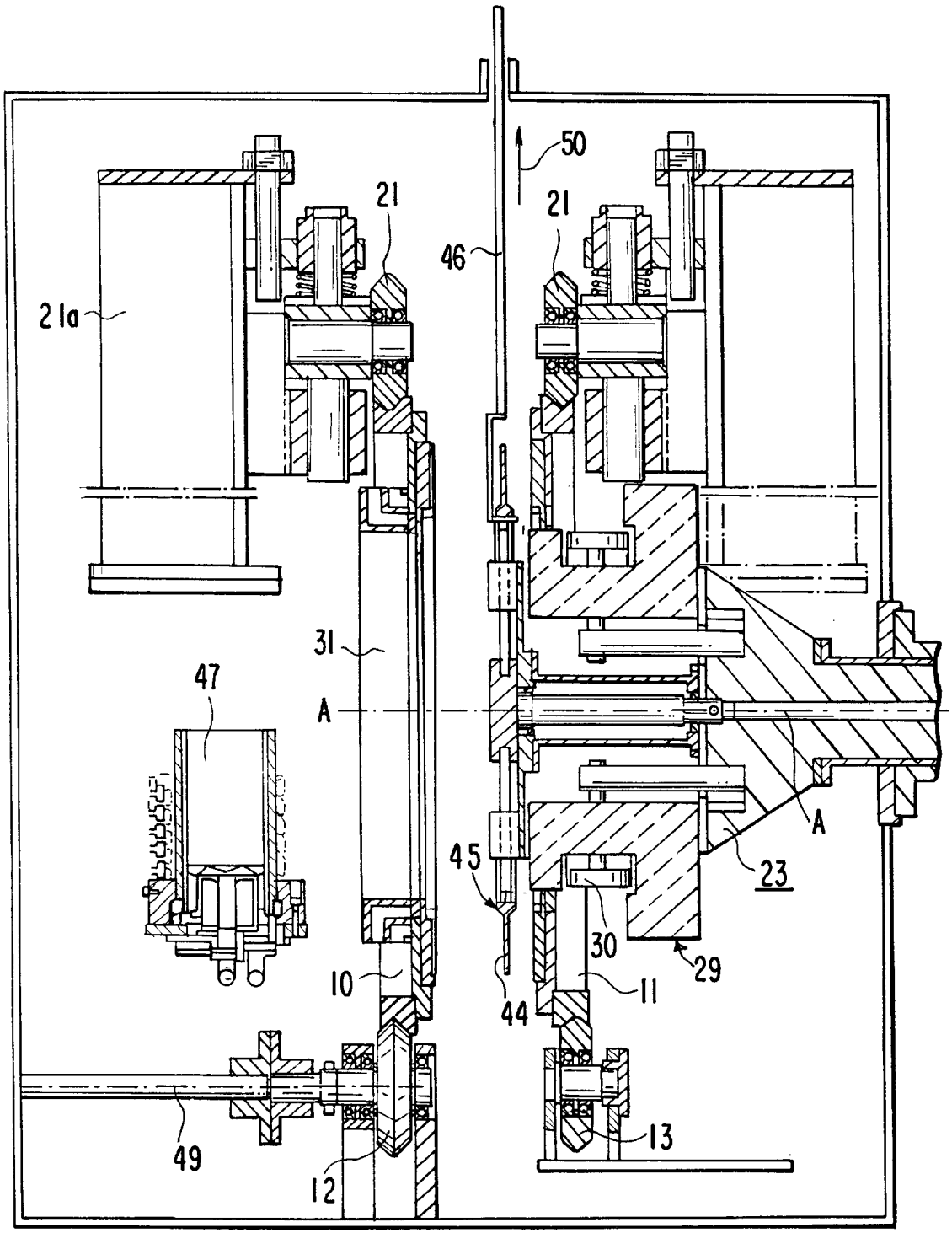
Figure 12:
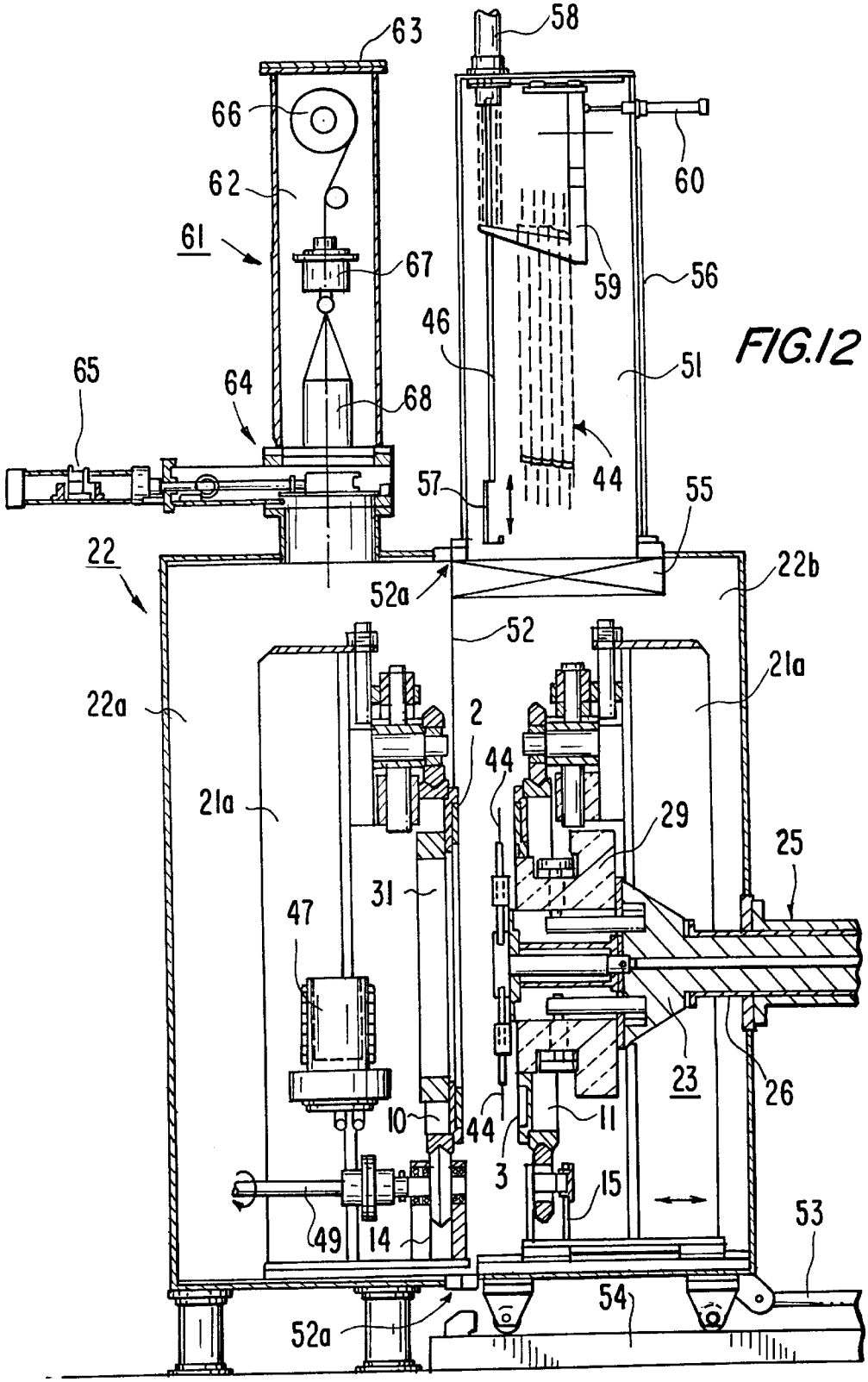

FIG. 1 is a fragmentary radial section through a mold having two mold parts, in the closed state, and through two wheels of the rotational guides, FIG. 2 a fragmentary radial section through a mold having two parts as in FIG. 1, in the open state, FIG. 3 an axial elevation of a sector-shaped detail of a mold part according to FIG. 1 or 2, FIG. 4 a fragmentary radial section through two molds with four mold parts in the closed state and through three wheels of the rotational guides, FIG. 5 a schematic representation of a rotational guide with four guide wheels for a mold part, as seen in the axial direction, FIG. 6 an axial section taken along line VI—VI in FIG. 5 through a manipulator unit with a clutching device for the removal of the castings and with a heating system for preheating the molds, FIG. 7 a schematic representation of another rotational guide with four guide wheels for a mold part, as seen in an axial direction opposite that of FIG. 5, supplemented by additional details of the clutching device for removing the castings, FIG. 8 a fragmentary vertical section through a complete apparatus in the phase of the preheating of a closed mold, taken along line VIII—VIII in FIG. 5, FIG. 9 the apparatus of FIG. 8 in the casting phase, FIG. 10 the apparatus of FIG. 8 after the opening of the mold and also the axial removal of the castings from the stationary mold part, FIG. 11 the apparatus of FIG. 8 after the mold is opened and also after the castings have been removed from the stationary mold part, FIG. 12 a vertical section through another embodiment of the invention with a divided chamber and a magazine to receive the castings, and FIG. 13 a vertical section through another embodiment of the invention with a mold whose plane of division is at an angle from the vertical.

In FIG. 1 is shown a mold 1 which consists of two parts 2 and 3 which abut one another gaplessly along a radial vertical plane of division E—E. The centrifugation axis A—A lies horizontally above and outside of the drawing. Each of the mold parts 2 and 3 consists, in mirror symmetrical arrangement, of a mounting ring 4 and 5, respectively, made of heat-resistant steel, each with an annular flange 4*a* and 5*a*, and of a plurality of exchangeable mold inserts 6 and 7 of niobium (preferably), tantalum, zirconium and/or alloys thereof. The mold inserts 6 and 7 meet one another in the plane of division E—E and between them in pairs they close mold cavities 8 with radial longitudinal axes. In the present case the mold cavities 8 serve for the production of valves for internal combustion engines.

The holding rings 4 and 5 reach radially inward past the mold inserts 6 and 7 and close between them a circumferential sprue runner 9 into which is cast a molten metal in the manner to be described further below, and there it hardens to form a closed ring. The valve heads are disposed inwardly and joined by the ring so that the hardening runs from the valve stem to the valve head.

The mold parts 2 and 3 and holding rings 4 and 5 are mounted so as not to rotate but to be removable in rotating guide elements 10 and 11 which are configured as annular tracks with grooves 10*a* and 11*a*. The guide elements 10 and 11 rest with their circumference on or in wheels 12 and 13 of which only one is shown here.

The wheels 12 and 13 are mounted coaxial with one another each in a pillow block 14 and 15, respectively, with shafts 14*a* and 15*a* of which the left shaft is fixed and the right pillow block 15 is displaceable in the direction of the arrow 15*b* so as to permit opening the mold 1 by the amount "D" in the plane of division E—E in order to remove the castings. The open state is shown in FIG. 2.

FIG. 3 shows an axial view of a sector-shaped section of the casting mold part 2 according to FIG. 1 with the radially inwardly projecting margin of the holding ring 4, the annular flange 4*a* and a plurality of radially disposed, sector-shaped mold inserts 6 which are held positively (e.g., by undercuts not shown) in the holding rings 4 and 5, so that they cannot be drawn radially inward under the influence of the radial component of shrinkage tensions in the crown of castings. In the case of an outside diameter DA of the mold parts of about 1070 mm, about 50 to 100 valves can be made in a single casting procedure, depending on the valve size.

FIG. 4 shows a further development of the subject of FIGS. 1 and 2, namely a fragmentary radial section through two molds 1 and 1' with four mold parts in the closed state and through three wheels 12, 13 and 17 of each rotational guide, which are coaxial with one another. Added are the mold 1' with the holding rings 18 and 19 and otherwise identical mold inserts 6 and 7 as well as an additional pillow block 16 with the wheel 17. In this case the two inner holding rings 4 and 19 are mounted in a mirror-image symmetrical arrangement in a common rotating guiding element 20 which is configured as an annular track with a groove 20*a*. The pillow block 14 is fixedly mounted, while the two pillow blocks 15 and 16 are displaceable in the opposite directions of the arrows 15*b* and 16*b*, so as to be able to open the molds 1 and 1' to, remove the castings, which is accomplished by an axially parallel displacement of the wheels.

In all cases the molds are fixedly joined together, and at least one of the wheels represented is driven, although this is not shown here.

FIG. 5 shows the bearing plan of mold 1 according to FIG. 1: beneath the centrifugation axis A two radially mounted wheels 12 are placed, at least one of which is driven, and above the centrifugation axis A two movable wheels 21 are arranged which can be moved radially against biased springs and are mounted in pillow blocks 21*a*, and they are displaceable relative to one another on opposite sides of the plane of division E—E (see for example direction of movement 21*b* in FIG. 8). All of the wheels have conical treads. Therefor the mold 1 can be driven tight and free of play at a high speed. The entire system is surrounded by a hermetic chamber 2 in which a vacuum or a inert gas atmosphere can be produced optionally or alternatively.

Before going further into the individual phases of the casting and stripping process in connection with FIGS. 8 to 11, a manipulator unit 23, which has to perform several functions, is to be described with the aid of FIGS. 6 and 7. In a wall 24 of the chamber 22 there is a sliding tubular feed-through 25 in which a guide tube 26 is carried for displacement by an amount "s". The displacement is performed through a transfer lever 27. Within the chamber 22 the guide tube 26 is connected to a carrier plate 28 on which an annular thermal insulation body 29 is fastened concentrically with the centrifugation axis A—A. The thermal insulation body, as seen in cross section, surrounds about three-fourths of the circumference of a likewise annular heater. The mold 1 is opened, much as represented in FIG. 2, and on the far side of this mold 1 an additional annular thermal insulating body 31 is stationary in the chamber 22, and when the manipulator unit 23 is displaced by the amount "s" it is supplemented by the thermal insulating body 29 such that only the cylindrical external surface of the heater 30 emits radiation energy, doing so in the heating phase when the mold 1 is in the closed state (see FIG. 8).

The heater 30 receives its energy, which can amount to 40 to 60 kW, through bus bars 32 which are fastened to the carrier plate 28 through insulation material inserts 33. The current is fed through cables 34, which are only indicated and pass sealingly through the guide tube 26. The mold parts are thereby heated at such a rate that a temperature gradient diminishing radially from the inside out is established, of at least 40° C., and preferably of at least 200° C.

Furthermore, a support tube 35 is fastened to the carrier plate 28, coaxially with the centrifugation axis A—A, and bears at its end remote from the carrier plate 28 an annular flange 36 to which a plurality of guide bushings 37 are fastened equidistantly around the circumference, and in them radial plungers (or grippers) 38 are carried. These plungers 38 are driven by bell cranks 39, which will be further explained with the aid of FIG. 7. The inner ends of the bell cranks 39 are fastened to a control plate 40 which is rotated by means of two shaft sections 41 and 42 which are passed through the support tube 35 and the guide tube 26 and are connected outside of the guide tube 26 to an actuating lever 43. The system described in this paragraph may also be called a "gripping device".

The explanation of this is as follows: The castings 44 (motor valves) are connected together by a ring 45 as a result of the casting process within the sprue runner 9 (FIG. 1). This ring 45 is engaged by the plungers 38, as long as the mold parts 2 and 3 are still closed. First the mold part 3 is drawn back by the corresponding guide wheels, and then the ring 45 with the castings 44 is pulled away from the mold part 2, to a position which is shown in FIG. 6. Then a catching device 46 comes down from above (or from the side) and takes the ring 45 with the castings 44 and carries them into a magazine where it hangs them up or deposits them (see FIG. 12, for example). The apparatus is then ready for another heating, casting and extracting process.

FIG. 8 shows the procedure of heating the closed mold 1 into which the heater 30 has been introduced concentrically by means of the manipulator unit 23. In this position, the heat insulators 29 and 31 enclose not only both sides and the back of the heater 30 but also the inner margins of the mold 1. At this point the mold is rotated at slow speed so as to achieve a very uniform temperature distribution. In an induction-heated crucible 47, a so-called water-cooled cold wall crucible, the molten casting material is held ready. The plungers 38 are disengaged and in the rest position.

FIG. 9 shows the casting process immediately after the heater 30 has been withdrawn from the closed mold 1 by the manipulator unit 23. When the mold 1 is at its lowest point a casting funnel 48 is swung to its opening above the sprue runner 9 (FIG. 1) and the crucible 47 with the molten casting material is swung to position 47' represented in broken lines, and is wholly or partially emptied into the casting funnel as the mold rotates. To impart to the stream of molten metal a tangential velocity component in the direction in which the mold is rotating it may be expedient to give the opening in the casting funnel 48 a certain aim. Also the plungers 38 have been withdrawn and are disengaged or in the rest position. One of the guide wheels is driven by an external motor and a shaft 49.

For a casting process of this kind the following figures are given by way of example:

| | |
|---|---|
| Liquidus temperature (material containing titanium) | 1480° C. |
| Density of the alloy | 3.6 kg/cm$^3$ |
| Volume of molten metal in crucible 47 | 1.5–2.5 liters |
| Speed of the mold | 350–400 rpm |
| Centrifugal force at the head of the valve | 50 g |
| Outside diameter OD of the mold | 1070 mm |
| Inside diameter ID of the mold | 750 mm |
| Mold opened and stripped at | 250° C. |

FIG. 10 shows one of the processes already described in connection with FIG. 6: The mold part 3 is already pulled back axially by the corresponding guide wheels, and the ring 45 with the castings 44 is held by the plungers 38.

FIG. 11 shows the left part of FIG. 6 in its entire environment on a reduced scale, i.e., the axial end position of the ring 45 with the castings 44 immediately before the catching device 46 is raised in the direction of arrow 50. Therefore there is no need of repetition.

FIG. 12 shows a vertical section through an embodiment of the invention with a divided chamber 22 which consists of the chamber sections 22*a* and 22*b* and a magazine 51 to receive the castings 44. The plane of division 52 is formed by a flanged coupling; with reference to FIGS. 2 and 11 it lies between the mold parts 2 and 3 and the corresponding rotation tracks with the guide wheels 12, 13 and 21. When the chamber sections 22*a* and 22*b* are separated the inside surfaces of the mold cavities 8 are accessible for inspection and cleaning, and also the mold inserts 6 and 7 can be replaced if desired.

The right chamber section 22 can be moved on rails 54 by means of an operating rod 53. The magazine 52 with a door 56 is disposed on chamber section 22*b*, with the interposition, if necessary, of a vacuum-tight shut-off valve 55. The catching device 46, which has a hook 57 at its lower end, can be withdrawn entirely within the magazine 51 by means of a vertical linear drive 58 and is able to hang the castings 44 in ring form on a hook 59 which can be pushed into the range of action of the catching device 46 by means of a horizontal linear drive 60. When the shut-off valve 55 is closed and door 56 is opened the castings 44 can be removed without disturbing the atmosphere in chamber 22.

By means of a charging apparatus 61 the crucible 47 can also be recharged without disturbing the atmosphere in chamber 22. An airlock 62 with a removable cover 63 and a sliding valve 64 with a drive unit 65 are part of the charging apparatus. A powered cable reel 66 is arranged in the airlock 62 and has a grabber 67 for a charge 68 which can be lowered all the way into the crucible 47.

In all of the figures thus far the same reference numbers are used for equal parts or parts with the same function. This also applies to FIG. 13.

FIG. 13 shows a vertical section through another embodiment of the invention with a casting mold whose plane of division, like the plane of division 52 of chamber 22, run at an angle of 15 degrees from the vertical. It is also possible, however, to arrange the plane of division and/or the plane of separation 52 at other angles and even, for example, to make it horizontal.

What is claimed is:

1. A method for the production of precision castings by centrifugation about a centrifugation axis, comprising casting in molds divided by at least one plane of division being radial to the centrifugation axis into annular mold parts, the precision castings when cast are united at radially inwardly pointing ends by a ring of solidified metal, with a plurality of mold cavities arranged at least substantially radially to the centrifugation axis, the molds and a casting apparatus being contained in a closed chamber, wherein said mold parts are brought to rotation in a rotation guide for each of the mold parts, and two mold parts together with corresponding rotation guides are brought relative to one another into a closed position for the casting operation and the solidification and into an open position for the removal of the precision castings, whereby movements of the mold parts into the closed and opened position are carried out in a direction parallel to the centrifugation axis and whereby the mold parts are reliably pressed together parallel to their radial plane of division.

2. A method according to claim 1, whereby the circumferential ring of solidified metal bearing the inwardly pointing ends of the precision castings is being cast within a sprue runner that is circumferential to the ring of solid material and connecting the radially inner ends of the mold cavities.

3. The method according to claim 1, herein the rotation guides of the mold parts are moved relative to one another between the closed position and the open position, and the casting apparatus for casting the melt when the mold is closed is brought into the plane of division and the casting is performed, the mold being opened after the melt has solidified, and the precision castings joined to one another by the ring are removed within the chamber from the plane of division.

4. The method according to claim 3, further comprising a manipulator system with a gripping device is disposed in the chamber, by means of which, with the mold closed, the castings on their ring are first picked up and fixed, that then the movable mold part is removed from the castings and the stationary mold part, and that then the castings are pulled by the gripping device from the stationary mold part and brought to an intermediate position between the opened molding parts, from which intermediate position the castings are removed to the exterior.

5. The method according to claim 1, wherein the mold palls are placed in coaxial position positively into two sets of guide wheels of which at least one guide wheel is driven.

6. The method according to claim 1, wherein the mold parts in coaxial position are heated to a casting temperature by a heating means brought concentrically into the plane of division.

7. The method according to claim 1, wherein the mold parts are heated up at such a rate that a temperature gradient diminishing radially from the inside out, of at least 40° C. is established.

8. The method according to claim 1, wherein the mold parts are heated at such a rate that a temperature gradient diminishing radially from the inside out, of at least 200° C. is established.

9. An apparatus for the production of precision castings by centrifugation about a centrifugation axis, comprising molds divided by at least one plane of division being radial to the centrifugation axis into annular mold parts with mold cavities disposed at least substantially radially to the centrifugation axis, the molds and a casting apparatus being contained in a closed chamber, wherein the mold parts are mounted in coaxial rotation guides and by means of these rotation guides can be brought relative to one another in an axial direction into a closed position for the casting operation and the solidification, and into an open position for the removal of the precision castings and comprising means for reliably pressing the mold parts together parallel to their at least one radial plane of division; the mold parts forming a circumferential sprue runner between them in their closed position, and connecting radially inner ends of the mold cavities to a circumferential ring of solidified metal bearing inwardly pointing ends of the precision castings.

10. The apparatus according to claim 9, wherein the rotation guides are movable relative to one another between a closed position and a removal position, that the casting apparatus for casting the melt with the mold closed can be brought to the plane of division, and further comprising a manipulator system within the chamber for the removal of the precision castings.

11. The apparatus according to claim 10, wherein the manipulator system has a radially acting gripping device by which the precision castings are removable from the mold parts.

12. The apparatus according to claim 9, wherein an outer circumference of the mold parts are provided with revolving guide elements and are held positively in coaxial position in sets of guide wheels of which at least one guide wheel is drivable.

13. The apparatus according to claim 9, wherein one of the mold parts is movable in the direction of the centrifugation axis together with the corresponding set of guide wheels relative to the other mold part and the other set of guide wheels.

14. The apparatus according to claim 9, wherein the centrifugation axis is aligned horizontally.

15. The apparatus according to claim 9, wherein the centrifugation axis is aligned at an angle to a horizontal plane.

16. An apparatus for the production of precision castings by centrifugation about a centrifugation axis, comprising molds divided by at least one plane of division being radial to the centrifugation axis into annular mold parts with mold cavities disposed at least substantially radially to the centrifugation axis, the molds and a casting apparatus being contained in a closed chamber, wherein the mold parts are mounted in coaxial rotation guides and by means of these rotation guides can be brought relative to one another in an axial direction into a closed position for the casting operation and the solidification, and into an open position for the removal of the precision castings and comprising means for reliably pressing the mold parts together parallel to their at least one radial plane of division, wherein the rotation guides are movable relative to one another between a closed position and a removal position, that the casting apparatus for casting the melt with the mold closed can be brought to the plane of division, and further comprising a manipulator system within the chamber for the removal of the precision castings, wherein the manipulator system has a radially acting gripping device by which the cohering precision castings are removable from the mold parts, wherein the gripping device comprises radially movable plungers.

17. The apparatus according to claim 16, wherein the plungers are actuated by a central shaft and bell cranks.

18. An apparatus for the production of precision castings by centrifugation about a centrifugation axis, comprising molds divided by at least one plane of division being radial to the centrifugation axis into annular mold parts with mold cavities disposed at least substantially radially to the centrifugation axis, the molds and a casting apparatus being contained in a closed chamber, wherein the mold parts are mounted in coaxial rotation guides and by means of these rotation guides can be brought relative to one another in an axial direction into a closed position for the casting operation and the solidification, and into an open position for the removal of the precision castings and comprising means for reliably pressing the mold parts together parallel to their at least one radial plane of division, wherein the manipulator system is provided on its outer circumference with a heat insulating body and a concentric heating body for heating the mold parts.

19. An apparatus for the production of precision castings by centrifugation about a centrifugation axis, comprising molds divided by at least one plane of division being radial to the centrifugation axis into annular mold parts with mold cavities disposed at least substantially radially to the centrifugation axis, the molds and a casting apparatus being contained in a closed chamber, wherein the mold parts are mounted in coaxial rotation guides and by means of these rotation guides can be brought relative to one another in an axial direction into a closed position for the casting operation and the solidification, and into an open position for the removal of the precision castings and comprising means for reliably pressing the mold parts together parallel to their at least one radial plane of division, wherein the chamber consists of two chamber sections with a plane of separation, and that the one mold part is mounted in the one chamber and the other mold part in the other chamber section.

20. The apparatus according to claim 19, wherein the chamber section in which the manipulator system is mounted, is connected to a magazine.

21. A method for the production of precision castings by centrifugation, comprising casting in molds divided by at least one plane of division into annular castings, with a plurality of mold cavities arranged at least substantially radially, to a centrifugation axis, the molds and a casting apparatus being contained in a closed chamber, wherein at least one mold part is brought to rotation in a rotation guide of its own, and two mold parts together with corresponding rotation guides are brought relative to one another into a closed position for the casting and the solidification and into an open position for removal of the precision castings, wherein the mold parts are heated up at such a rate that a temperature gradient diminishing radially from the inside out, of at least 40° C. is established.

22. A method for the production of precision castings by centrifugation, comprising casting in molds divided by at least one plane of division into annular castings, with a plurality of mold cavities arranged at least substantially radially to a centrifugation axis, the molds and a casting apparatus being contained in a closed chamber, wherein at least one mold part is brought to rotation in a rotation guide of its own, and two mold parts together with corresponding rotation guides are brought relative to one another into a closed position for the casting and the solidification and into an open position for the removal of the precision castings, wherein the mold parts are heated at such a rate that a temperature gradient diminishing radially from the inside out, of at least 200° C. is established.

23. An apparatus for the production of precision castings comprising molds divided by at least one plane of division into annular casting rings or casting forms or mold parts with mold cavities disposed at least substantially radially to a centrifugation axis, the molds and a casting apparatus being contained in a closed chamber, wherein the mold parts are mounted in coaxial rotation guides and by means of these rotation guides can be brought relative to one another into a closed position for the casting operation and the solidification, and into an open position for the removal of the precision castings wherein the rotation guides are movable relative to one another between a closed position and a removal position, the casting apparatus for casting the melt with the mold closed can be brought to the plane of division, and further comprising a manipulator system within the chamber for the removal of the precision castings, wherein the manipulator system has a radially acting gripping device by which the cohering precision castings are removable from the mold parts wherein the gripping device comprises radially movable plungers.

24. The apparatus according to claim 23, wherein the plungers are actuated by a central shaft and bell cranks.

25. An apparatus for the production of precision castings comprising molds divided by at least one plane of division into annular casting rings or casting forms or mold parts with mold cavities disposed at least substantially radially to a centrifugation axis, the molds and a casting apparatus being contained in a closed chamber, wherein the mold parts are mounted in coaxial rotation guides and by means of these rotation guides can be brought relative to one another into a closed position for the casting operation and the solidification, and into at an open position for the removal of the precision castings wherein a manipulator system is provided on its outer circumference with a heat insulating body and a concentric heating body for heating the mold parts.

26. An apparatus for the production of precision castings comprising molds divided by at least one plane of division into annular casting rings or casting forms or mold parts with mold cavities disposed at least substantially radially to a centrifugation axis, the molds and a casting apparatus being contained in a closed chamber, wherein the mold pals are mounted in coaxial rotation guides and by means of these rotation guides can be brought relative to one another into a closed position for the casting operation and the solidification, and into an open position for the removal of the precision castings wherein the chamber consists of two chamber sections with a plane of separation, and that the one mold part is mounted in the one chamber section and the other mold part in the other chamber section.

27. The apparatus according to claim 26, herein the chamber section in which the manipulator system is mounted, is connected to a magazine.

* * * * *